US007597304B1

(12) United States Patent
Gray

(10) Patent No.: US 7,597,304 B1
(45) Date of Patent: Oct. 6, 2009

(54) CHRISTMAS TREE STAND

(76) Inventor: Daniel Gray, 1775 Blackjack Rd., Tallassee, AL (US) 36078

( * ) Notice: Subject to any disclaimer, the term of this patent is extended or adjusted under 35 U.S.C. 154(b) by 0 days.

(21) Appl. No.: 11/479,929

(22) Filed: Jun. 30, 2006

(51) Int. Cl.
*F16M 13/00* (2006.01)

(52) U.S. Cl. ..... 248/523; 248/172; 248/524; 47/40.5

(58) Field of Classification Search ..... 248/523, 248/205.3, 511, 519, 516, 151; 47/40.5
See application file for complete search history.

(56) References Cited

U.S. PATENT DOCUMENTS

| | | | | | |
|---|---|---|---|---|---|
| 1,110,142 | A | | 9/1914 | Piner | |
| 1,695,275 | A | * | 12/1928 | Davis | 248/523 |
| 2,689,701 | A | * | 9/1954 | Whitaker | 248/524 |
| 2,853,261 | A | * | 9/1958 | Loeb | 248/151 |
| 2,875,968 | A | * | 3/1959 | Ekola | 47/40.5 |
| 3,231,226 | A | | 1/1966 | Rossler | |
| 3,295,802 | A | * | 1/1967 | Leatherman | 248/523 |
| 3,302,909 | A | | 2/1967 | Glassman | |
| 4,088,294 | A | * | 5/1978 | Aliment et al. | 248/519 |
| 4,261,138 | A | | 4/1981 | St. George Syms | |
| 4,429,846 | A | * | 2/1984 | Halvorson | 248/524 |
| 4,496,129 | A | * | 1/1985 | Waterman et al. | 248/527 |
| 4,699,347 | A | * | 10/1987 | Kuhnley | 248/516 |
| 4,825,586 | A | * | 5/1989 | Coppedge | 47/40.5 |
| 5,071,098 | A | * | 12/1991 | Aldridge | 248/219.4 |
| 5,114,113 | A | | 5/1992 | Krinner | |
| 5,249,772 | A | | 10/1993 | Montie, Jr. et al. | |
| 5,337,990 | A | * | 8/1994 | Brown | 248/526 |
| 5,362,024 | A | * | 11/1994 | Grinnen | 248/524 |
| 5,577,701 | A | * | 11/1996 | Plzak | 248/524 |
| 5,601,263 | A | * | 2/1997 | Thayer | 248/75 |
| 5,732,926 | A | | 3/1998 | Baumgartner | |
| 5,797,579 | A | | 8/1998 | Krinner | |
| 5,966,865 | A | * | 10/1999 | Jones | 47/41.01 |
| 6,142,441 | A | * | 11/2000 | Vannucci | 248/519 |
| D444,412 | S | | 7/2001 | Krinner et al. | |
| D454,518 | S | | 3/2002 | Krinner et al. | |
| 6,612,071 | B1 | * | 9/2003 | Steadman | 47/42 |
| 2005/0230593 | A1 | | 10/2005 | Wynn | |
| 2005/0236549 | A1 | | 10/2005 | Eckenswiller | |

FOREIGN PATENT DOCUMENTS

| | | | |
|---|---|---|---|
| GB | 2208591 | A1 | 4/1989 |

* cited by examiner

*Primary Examiner*—Anita M King

(57) ABSTRACT

What is disclosed is an improved Christmas tree stand employing a Velcro® hook and loop strap to lock in place the clamping means for the tree trunk.

4 Claims, 3 Drawing Sheets

CHRISTMAS TREE STAND

FIELD OF THE INVENTION

The present invention is a novel Christmas tree stand.

BACKGROUND OF THE INVENTION

Christmas tree stand designs are numerous. Most of these use metal or plastic components such as bolts or clamps to fix the tree trunk in place. It has not been known in the art to use Velcro® products in general and specifically Velcro® hook and loop straps to provide the force to lock the tree trunk in place.

BRIEF DESCRIPTION OF THE FIGURES

FIG. 2 is taken along the line 2-2 of FIG. 4. FIG. 2 also contains a sectional view of a sliding member which is unconnected to the base of the stand. This latter sliding member is identical to the one which is also shown in FIG. 2.

DETAILED DESCRIPTION

Figure 1:
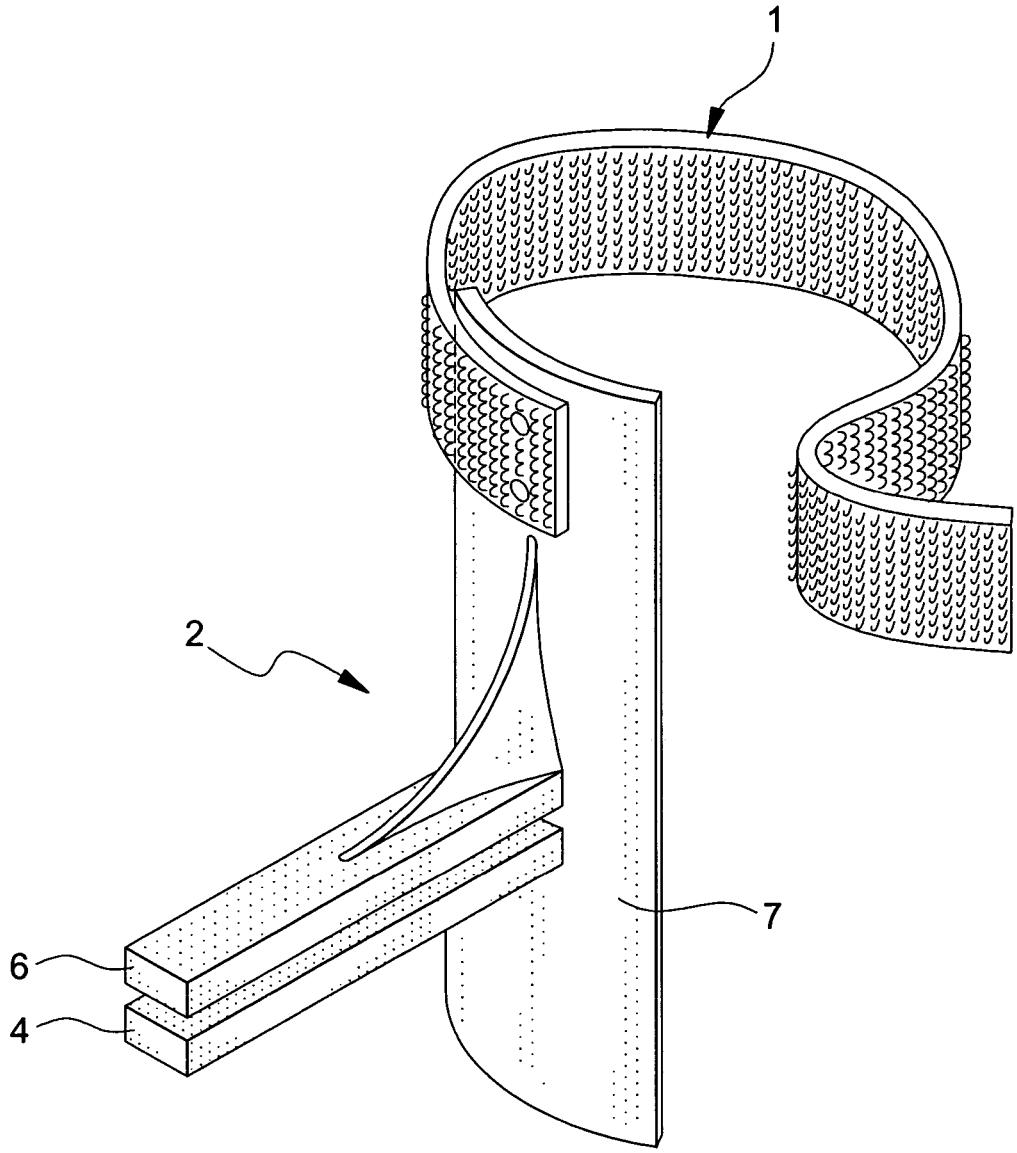
FIG. 1 is a view, in one embodiment of the invention, of one of the sliding members with an attached Velcro® hook and loop strap.
Figure 2:
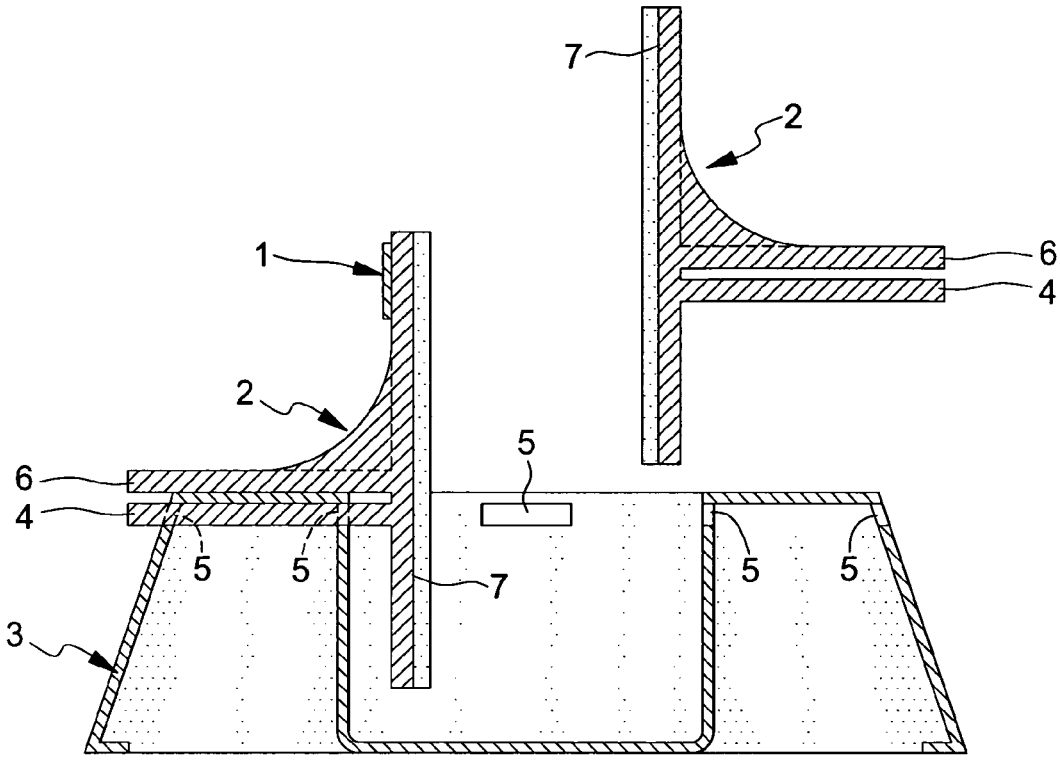
FIG. 2 is a sectional view, in one embodiment of the invention, of the base and one of the sliding members with a Velcro® hook and loop strap.
Figure 3:
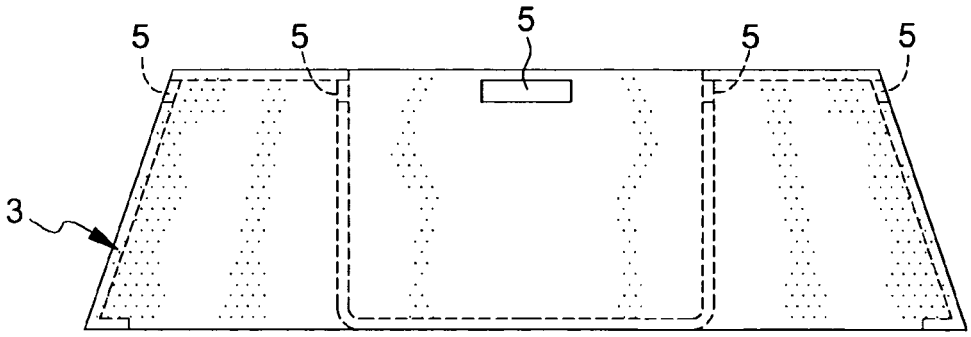
FIG. 3 is a side view of the base showing the opening through which, in one embodiment of the invention, a lower rail of the sliding member moves.
Figure 4:
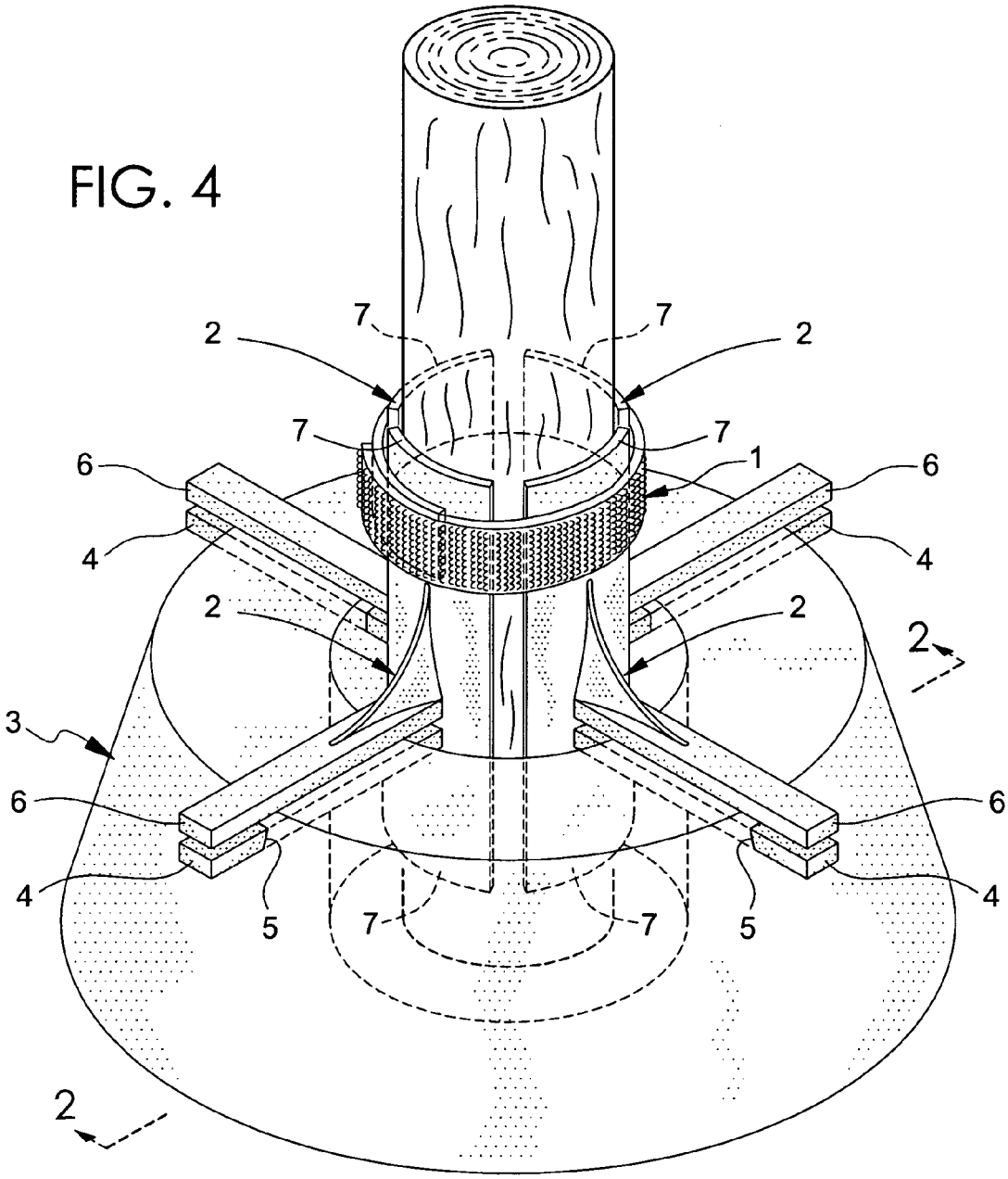
FIG. 4 is a three dimensional view of a Christmas tree trunk seated in the Christmas tree stand whose clamping means, in one embodiment of the invention, contains four sliding members. The Velcro® hook and loop strap is engaged in position to maintain the sliding members in a fixed position in close proximity to the trunk.

The invention is a stand for any ornamental object such as a Christmas tree. A Christmas tree can be natural or artificial. As used herein, the terms "tree stand" and "Christmas tree stand" are used interchangeably to refer to the invention in its broadest form.

The invention is a novel combination of several elements including clamping means and a Velcro® fastener which, in one embodiment, is a Velcro® hook and loop strap (also described herein as "the strap") 1 to fix the sliding members in position in close proximity to the tree trunk. "Clamping means" include any means to position a support for the tree trunk which includes, without limitation, sliding members 2 with a face 7 which is concave on the side closest to the tree. In one embodiment, the invention also uses the bowl-shaped base 3 which is well known in the art and, in the embodiment depicted, seats the sliding members with a lower rail 4 which travels within an opening in the base 5. The inner portion of the base is preferentially configured as a bowl to allow it to serve as a reservoir for water, although for artificial trees the bowl shaped base is not necessary. The outer portion of the base can be configured in any decorative shape such as that of an ornament or other holiday symbols. In one embodiment, each sliding member has a lower rail 4, an upper rail 6, and a face 7. The face 7 is the structure which is in contact with the tree trunk, and the face is preferably concave in order to maximize its surface area contacting the tree trunk, thus increasing stability and preventing gouging of the tree trunk.

In one embodiment, the lower rails and upper rails are connected to the face by any permanent means such as rivets, bolts, screws, welds, or glue. The lower rail can be cast of one material with the face through a casting or molding process. The lower rail and upper rail are not connected to one another directly. The number of sliding members is preferably at least two and no more than four. The smaller the tree the fewer the sliding members can be used.

The Velcro® hook and loop strap 1 is preferentially a single strap with the hook portion on one side and the loop on the other. It can thus lock the sliding members in place, which in turn hold the tree trunk in place. The Velcro® hook and loop strap 1 can either be unattached to the sliding members and simply locked into place, or one end of the Velcro® hook and loop strap 1 can be attached to one of the sliding member faces. If attached, the means can be rivets, bolts, screws, welds, or glue or any other permanent means including a slot in one of the sliding members to thread the Velcro® hook and loop strap through, as long as means are provided to keep the end of the strap from coming though the slot. One suitable Velcro® hook and loop strap is described as One-Wrap® or by Velcro® part number 90700 which is described at www.velcro.com. For the typical household size Christmas tree stand, the Velcro® hook and loop strap is preferentially from ⅞ inches to 2 inches wide, and from 18 inches to 24 inches long, but the strap dimensions can be larger or smaller as the size of the Christmas tree stand varies. The term Velcro® hook and loop is defined in this specification and in the claims to include any Velcro product which can wrap around a cylinder and lock itself into place by means of multiple hooks and loops.

I claim:

1. A Christmas tree stand comprising:

a base with an opening at the top for receiving a Christmas tree trunk;

clamping means affixed to the base for clamping the tree trunk, wherein said clamping means comprises at least two sliding members, each of which moves through one of a plurality of sliding member openings, respectively and wherein the sliding member openings extend through respective sidewalls in the base, each sliding member having a rail which slides inwardly toward a center of the base through the sliding member openings after the Christmas tree trunk is inserted into the base, and wherein the sliding members do not touch the ground, and each said rail being attached to a face which is adapted to contact the Christmas tree trunk; and at least one strap wrapped around the clamping means in order to lock the clamping means into place around the clamping means in order to lock the clamping means into place around the Christmas tree trunk, wherein each face comprises an interior surface which is adapted to contact the Christmas tree trunk, and said interior surface being concave.

2. A method for using at least one strap to lock a Christmas tree trunk into a stable position in a stand, said method comprising the steps of:

providing a Christmas tree;

providing a stand with a base with clamping means for clamping a Christmas tree trunk, wherein said clamping means comprises at least two sliding members, each of which slides through one of a plurality of sliding member openings, respectively, and wherein the sliding member openings extend through respective sidewalls in the base, each sliding member having a rail which slides inwardly toward the Christmas tree trunk through the sliding member openings and wherein the sliding members do not touch the ground, and each said rail being attached to a face which contacts the Christmas tree trunk;

providing at least one strap to lock the Christmas tree into a stable position in the stand;

inserting the Christmas tree trunk into the stand; and locking the at least one strap around the clamping means, and wherein each face comprises an interior surface which contacts the Christmas tree trunk, said interior surface being concave.

3. A Christmas tree stand, comprising:

a base with an opening at the top for receiving a Christmas tree trunk;

clamping means affixed to the base for clamping the tree trunk, wherein said clamping means comprises at least two sliding members, each of which moves through one of a plurality of sliding member openings, respectively and wherein the sliding member openings extend through respective sidewalls in the base, each sliding member having a rail which has a first position prior to insertion of the Christmas tree trunk into the base, and slides inwardly towards a center of the base to a second position in which the sliding member is adapted to contact the Christmas tree trunk, and wherein the sliding members do not touch the ground, and each said rail being attached to a face which is adapted to contact the Christmas tree trunk; and at least one strap wrapped around the clamping means in order to lock the clamping means into place around the clamping means in order to lock the clamping means into place around the Christmas tree trunk, wherein each face comprises an interior surface which is adapted to contact the Christmas tree trunk, and said interior surface being concave.

4. A method for using at least one strap to lock a Christmas tree trunk into a stable position in a stand, said method comprising the steps of:

providing a Christmas tree;

providing a stand with a base with clamping means for clamping a Christmas tree trunk, wherein said clamping means comprises at least two sliding members, each of which slides through one of a plurality of sliding member openings, respectively, and wherein the sliding member openings extend through respective sidewalls in the base, each sliding member having a rail has a first position prior to insertion of the Christmas tree trunk into the base, and slides inwardly to a second position in which the sliding members contact the Christmas tree trunk, and wherein the sliding members do not touch the ground, and each said rail being attached to a face which contacts the Christmas tree trunk; and providing at least one strap to lock the Christmas tree into a stable position in the stand;

inserting the Christmas tree trunk into the stand; and locking the at least one strap around the clamping means, and wherein each face comprises an interior surface which contacts the Christmas tree trunk, said interior surface being concave.

* * * * *